United States Patent [19]

Anderson

[11] 4,408,439

[45] Oct. 11, 1983

[54] METHOD AND APPARATUS FOR WRAPPING AN ARTICLE

[75] Inventor: Andrew W. Anderson, West Caldwell, N.J.

[73] Assignee: Scandia Packaging Machinery Company, Clifton, N.J.

[21] Appl. No.: 235,367

[22] Filed: Feb. 19, 1981

[51] Int. Cl.[3] ..... B65B 11/42; B65B 53/02

[52] U.S. Cl. ..... 53/461; 53/466; 53/442; 53/557; 53/228; 53/234

[58] Field of Search ..... 53/442, 557, 234, 228, 53/465, 466, 461, 203; 426/412

[56] References Cited

U.S. PATENT DOCUMENTS

| | | | |
|---|---|---|---|
| 1,816,085 | 7/1931 | Langhammer | 53/466 |
| 2,071,300 | 2/1937 | Gammatter | 426/412 |
| 2,783,599 | 3/1957 | Weikert | 53/442 X |
| 3,055,490 | 9/1962 | Anderson | 53/234 X |
| 3,541,753 | 11/1970 | Katz | 53/442 |
| 3,587,839 | 6/1971 | Von Brecht | 53/442 X |
| 3,866,386 | 2/1975 | Ganz | 53/442 X |

*Primary Examiner*—John Sipos

*Attorney, Agent, or Firm*—Neil F. Markva

[57] ABSTRACT

The method provides a loose wrap on an article. A sheet of thin, flexible wrapping material is positioned around the article. A projecting flexible excess portion is formed as an outwardly projecting bubble in the wrapping material that is positioned around the article. The wrapping material is then sealed around the article while the bubble portion is maintained in the wrapping material. The apparatus comprises various mechanisms for effecting the method steps. The assembly is particularly useful in a wrapping machine. The combination used in conjunction with a wrapping machine includes a pocket mechanism for holding the article having the thin, flexible material wrapped therearound. The projecting bubble portion is formed by an assembly disposed adjacent the pocket mechanism. The pocket mechanism includes a side wall member having an indentation to receive the projecting bubble portion formed in the wrapping material. The bubble portion forming assembly includes a backing member disposed adjacent the side wall member of the pocket assembly and has a shaped supporting surface against which the bubble portion is conformed in shape.

22 Claims, 9 Drawing Figures

METHOD AND APPARATUS FOR WRAPPING AN ARTICLE

FIELD OF THE INVENTION

This invention relates to a method of wrapping packages and generally to wrapping machines. More particularly, the invention relates to an assembly having a plurality of pocket members in which various operations are effected to overwrap an article with a thin, flexible material.

BACKGROUND OF THE INVENTION

Wrapping machines having a pocket assembly for effecting a plurality of wrapping operations are well known. U.S. Pat. Nos. 3,055,490, 3,877,203 and 4,143,503 represent specific types of wrapping machines in which the present invention may be incorporated. The disclosures of these earlier patents are specifically incorporated herein by reference to further set forth the manner in which the various parts operate with respect to each other.

It is specifically noted, however, that the method and apparatus of the present invention may be readily adapted to any type of wrapping machine or assembly wherein it is desired to provide a loose wrap onto an article.

It has been found that in many instances where a package is being overwrapped with a heat sealable wrapping material, such as polyethylene or polypropylene that the overwrapped package may become too tight through shrinkage. This shrinkage may occur during the heat shrink operation or while the package is stored on the shelf before actual sale of the item. The concept of having a loosely wrapped article passing through a shrink film oven is generally known as shown in U.S. Pat. Nos. 3,717,939, 3,826,017 and 3,869,844. These references simply show the transporting of a loosely wrapped article through a standard heat shrink tunnel. The control of the amount of shrinkage in these wrap is effected by controlling the temperature of the tunnel and the amount of time spent by the articles in the shrinking zones.

When a package that is overwrapped with heat sealable material shrinks after the package has been placed on the shelf, the package may become distorted and/or actually have breaks formed therein. This type of shrinkage thus causes an unsatisfactory condition in the products being sold from a visual standpoint and also with respect to freshness of the articles packaged therein.

PURPOSE OF THE INVENTION

The primary object of the invention is to provide a method for effecting the wrapping of an article with a thin, flexible overwrap material which is loosely wrapped to compensate for any shrinkage which might occur after the wrapping operation has been completed.

Another object of the invention is to provide an assembly for effecting the method of overwrapping an article with a loose wrap condition to obviate any disadvantages associated with known wrapping operations.

SUMMARY OF THE INVENTION

The method of the invention as described herein comprises the steps of positioning a sheet of thin, flexible wrapping material around the article. A projecting flexible excess portion is formed in the wrapping material which has been positioned around the article. Then, while maintaining the excess portion, the wrapping material is sealed in a standard manner. The basic concept of forming a projecting flexible excess portion as an outwardly extending bubble in the wrapping material may be used in connection with numerous types of packages. However, this particular method is extremely well suited for use with four-sided packages which are used for containing items such as cigarettes, candy, cigars and the like.

In a particular embodiment of the invention, the sheet of wrapping material is draped around the article to form at least one end portion which includes a free edge of the sheet and projects outwardly from the article. The outwardly projecting bubble portion is formed at a location laterally displaced from the free edge of the end portion. In a specific embodiment, the excess portion is formed as a bubble across the entire width of the sheet of material positioned around the article.

The assembly of this invention is used to effect the method described herein. The assembly comprises means for positioning a sheet of thin, flexible wrapping material around an article. Means for forming a projecting flexible excess portion is disposed adjacent the article wrapped with the sheet of wrapping material. A sealing means is used to seal the wrapping material around the article while maintaining the excess portion in the wrapping material. This assembly may be used in combination with a wrapping machine including a means for draping a sheet of thin, flexible material around the article having a plurality of planar sides. The draping means is effective to form at least one end portion including a free edge of the sheet with the end portion projecting outwardly from the article. Pocket means holds the article having the thin, flexible material wrapped therearound, and the excess portion forming means is disposed adjacent the pocket means. A side wall member of the pocket means has an indentation to receive the excess portion which is formed in the wrapping material. The excess portion forming means may be used to maintain the excess portion in the wrapping material as the article moves from a first working position to a sealing working station. A particular feature of the invention is that the excess portion is shaped as a bubble which projects outwardly from the article.

Another feature is directed to the structure of the excess portion forming means which includes shaped backing means having a shaped supporting surface which supports the excess portion formed in the thin flexible material. The excess portion has a shape conforming to the shape of the supporting surface. The excess portion forming means includes means for holding the thin, flexible material against the shaped supporting surface. Such holding means may include the use of a vacuum, a mechanical assembly or a combination of both.

In a specific embodiment, the material holding means includes a pushing member having an abutment face which pushes the thin, flexible material against the shaped supporting surface. The abutment face is shaped to conform to the shape of the supporting surface. The pushing member may include a lever member pivotally mounted to move between an open position and a holding position. The abutment face is disposed at a free end of the lever member. A cam follower is disposed at the other end of the lever member and operates in conjunction with a cam disc mounted on the shaft about which the lever member rotates. An alternative structure of the cam assembly is the use of an annular, split ring member having a removable section and a shaped cam surface for contact with the cam follower. Bracket means is used for securing the removable section to maintain the split ring member as a unit placed to function in conjunction with the cam follower of the lever member.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 7 is an elevational view of a further embodiment of an assembly made in accordance with this invention.

DETAILED DESCRIPTION

Figure 1:
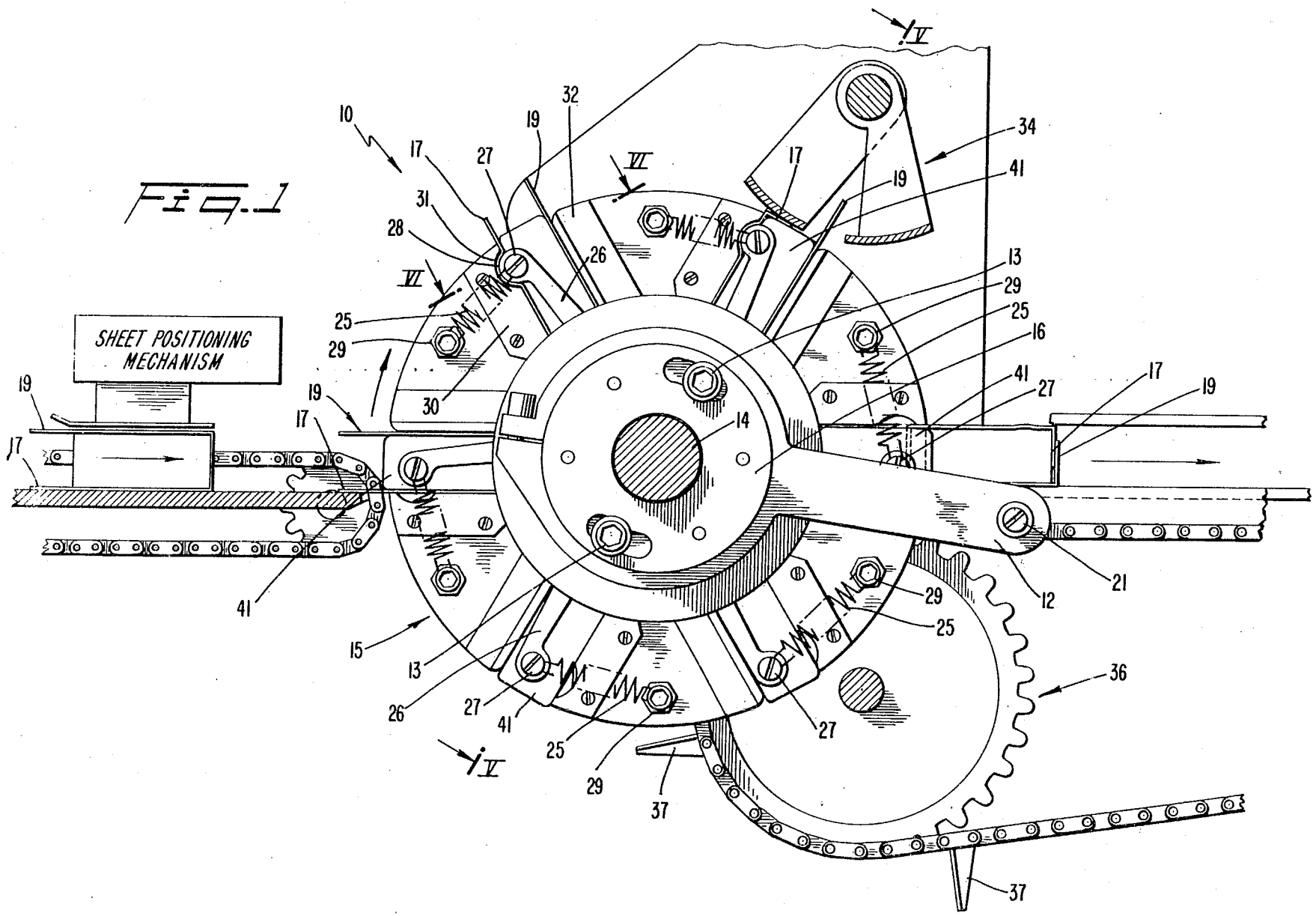
FIG. 1 is an elevational view, partially in section, of an assembly made in accordance with this invention.
Figure 2:
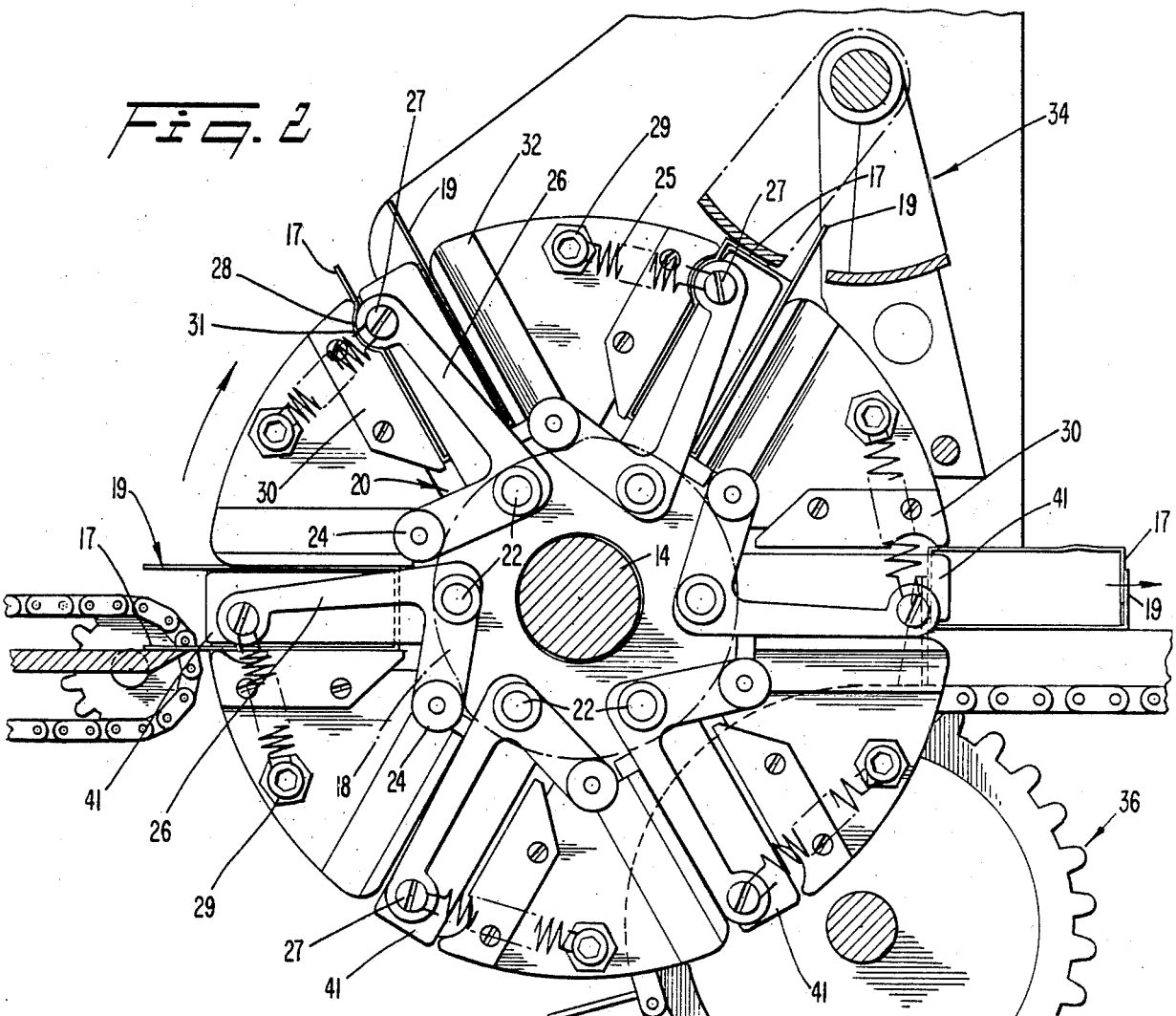
FIG. 2 is a fragmentary elevational view of the assembly as shown in FIG. 1, FIG. 3 and FIG. 4 are detail elevational views showing the operation of a material holding means made in accordance with this invention.

The assembly, generally designated 10, is used to provide a loose wrap on an article 11 which, in this case, has a rectangular cross-sectional case. The articles 11 are fed into a well-known geneva wheel assembly 15 after having a sheet 19 of wrapping material draped around the article 11. At least one end portion of sheet 19 includes a free edge 17 and projects outwardly from article 11 as shown.

The assembly 10 is used to form a projecting, flexible excess portion in the sheet 19 once it has been draped around article 11. The excess portion is formed as a bubble across the width of sheet 19 and projects outwardly from article 11. As shown, the excess portion is formed at a location laterally displaced from the free edge 17. In this specific embodiment, the flexible wrapping material consists of a heat sealable material. Thus, as the geneva assembly 15 moves the package around a circumference, the heat sealing assembly 34 is used to fold the outwardly projecting end portions of the wrapper sheet as shown.

Each article 11 draped with sheet 19 is thrust between the side wall members 30 and 32 in a well known manner. The side wall member 30 has an indentation 31 to receive the excess portion formed in the sheet 17 by the material holding assembly 20, including a lever member 26 pivotally mounted around bushing 22.

The shaped supporting surface 31 forms a part of the shaped backing means adjacent the side wall member of the pocket in the geneva assembly 15. That is, the side wall member includes an indentation along with the shaped supporting surface against which the abutment face 28 pushes the thin flexible material of the sheet 19. The abutment face 28 is shaped to conform to the shape of the supporting surface 31. The abutment face 28 is located at the free end of lever member 26.

A cam member 18 is mounted around the shaft 14 on which the geneva assembly 15 is mounted. A cam follower 24 is located at the end of the lever member 26 and is in contact with the surface of cam member 18. A spring member 25 is anchored on the geneva assembly with bolt 29 and at the other end thereof to the lever member 26 by stud 27. Spring 25 constitutes a biasing means which urges the lever member 26 to a holding position where the abutment face 28 pushes the flexible material of sheet 19 against the shaped surface 31. As the geneva wheel rotates, the cam follower 24 is raised and lowered with respect to the axis of the shaft 14, thereby moving the lever between an open position or holding position. That is, the surface of cam member 18 effects a positive displacement of the lever member to the open position in this particular embodiment.

The cam member 18 is located in the proper position within a cam hub 16 which is fixedly disposed on shaft 14 via the bracket member 12. A stud 21 fixes the bracket 12 to a stationary support or frame of the wrapping machine. The bolts 13 are used to adjust the position of the cam member 18 at the appropriate location to effect the displacement of the abutment face 28 between the opening and holding positions.

Figure 3:
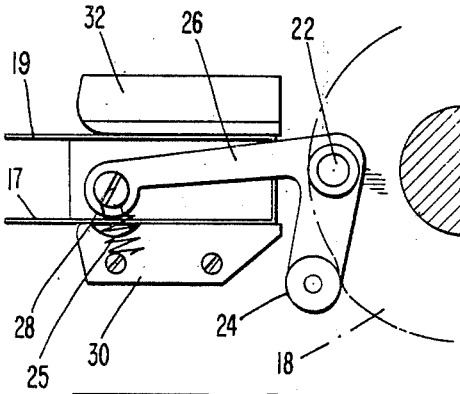
Figure 4:
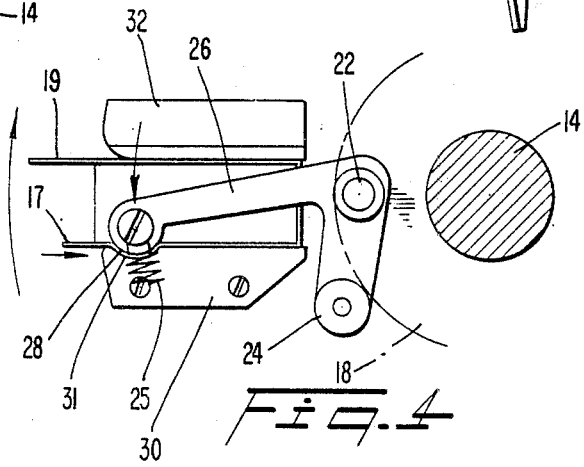
Figure 5:
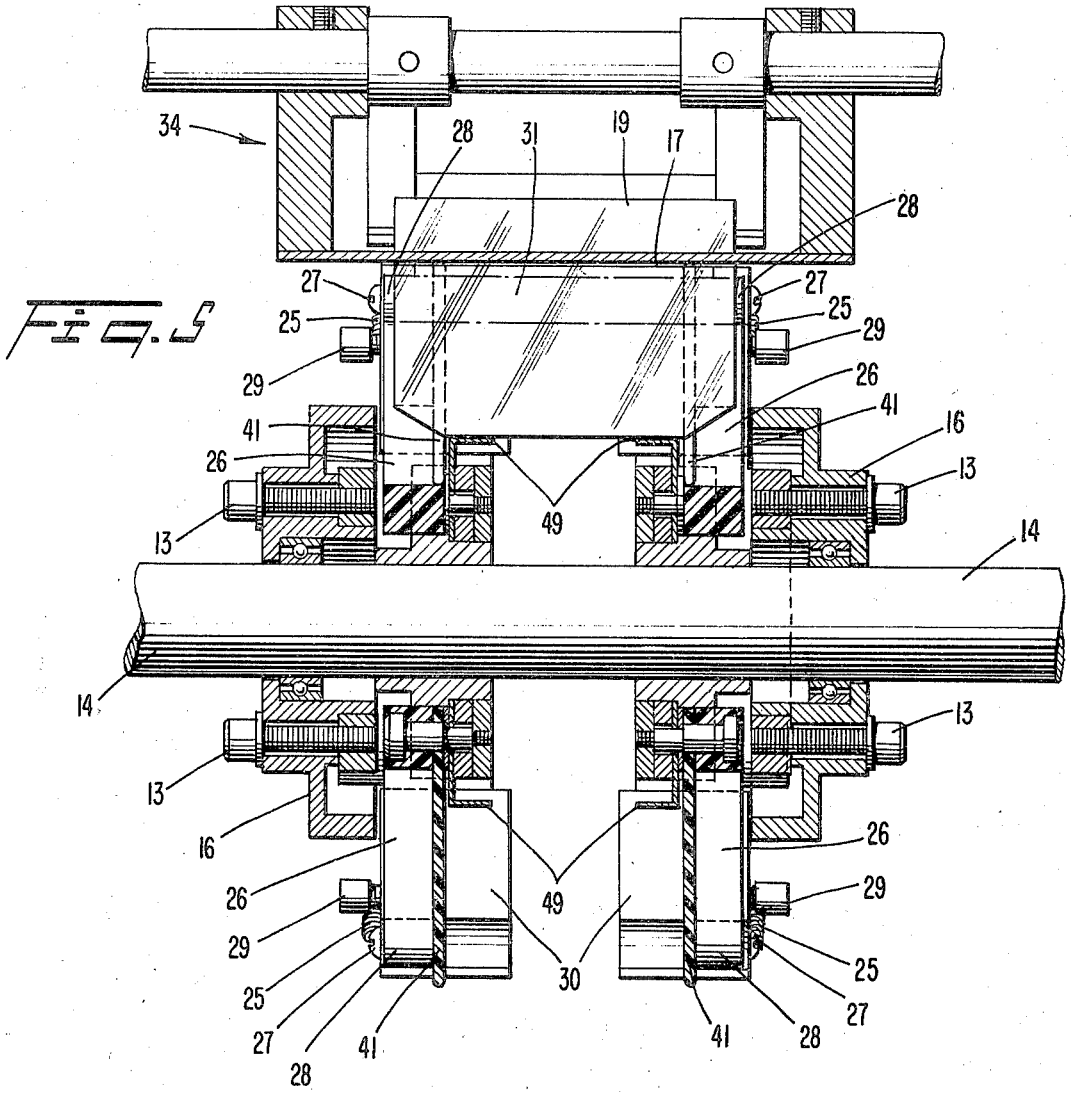
FIG. 5 is a sectional view along line V—V of FIG. 1.
Figure 6:
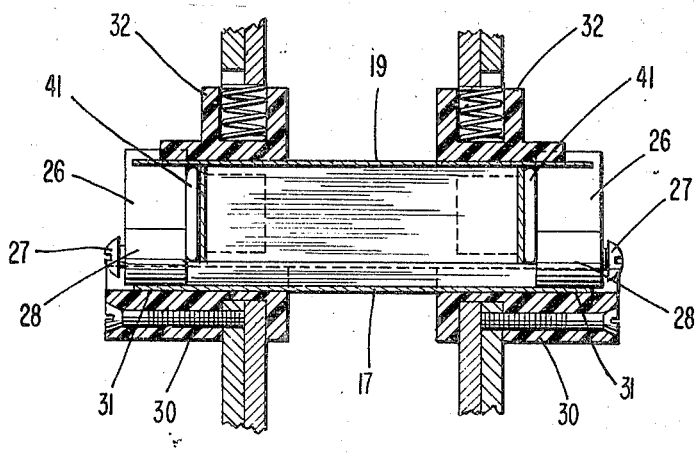
FIG. 6 is a sectional view along line VI—VI of FIG. 1.
Figure 1:
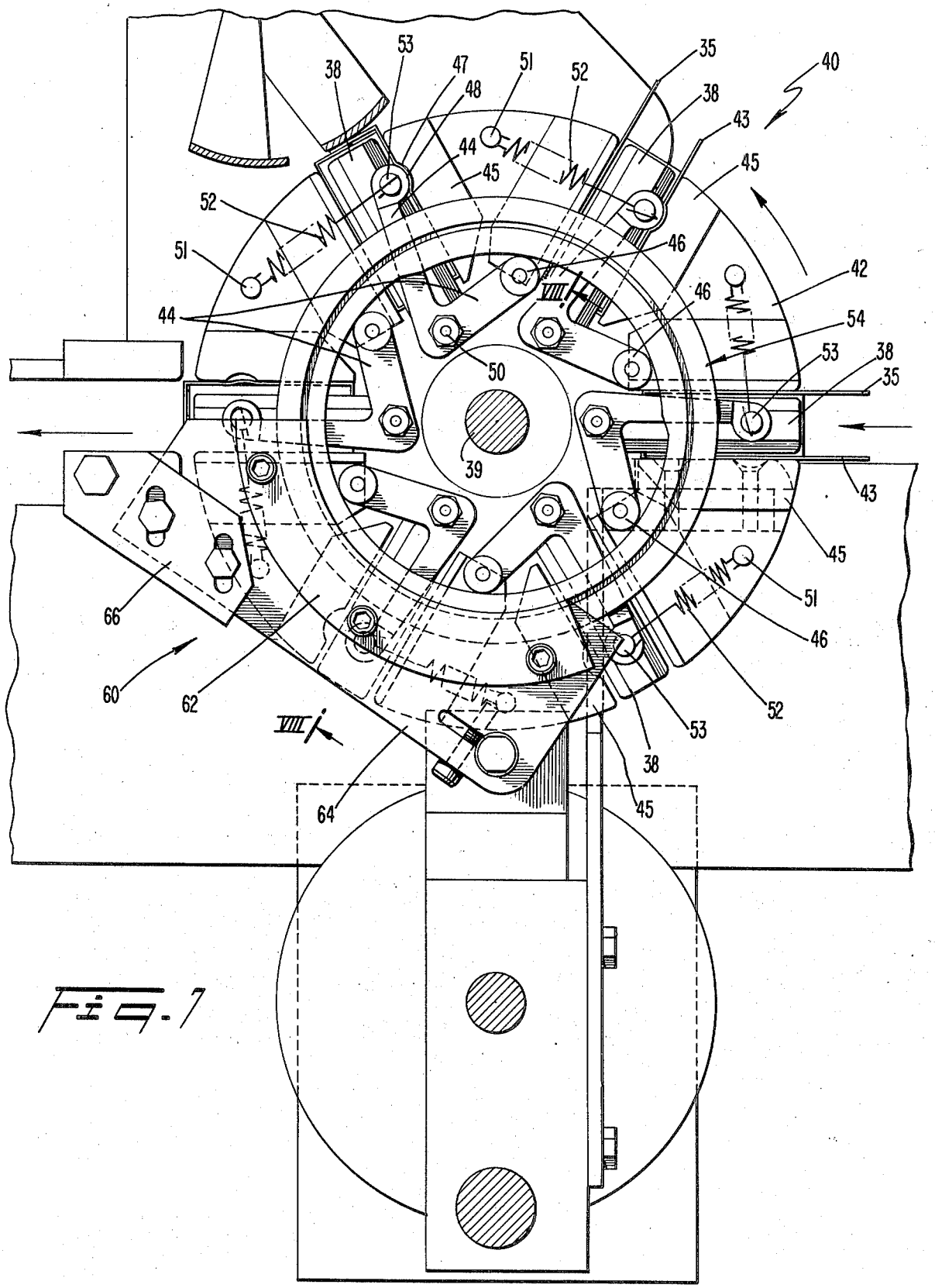

The detailed drawings shown in FIGS. 3 and 4 show the relationship between the abutment face 28, the supporting surface 31 and the operation of the cam follower 24 with respect to the surface of the cam member 18.

The pusher assembly 36, having pusher members 37, ejects the articles 11 from the geneva assembly 15 in a well known manner.

Figure 8:
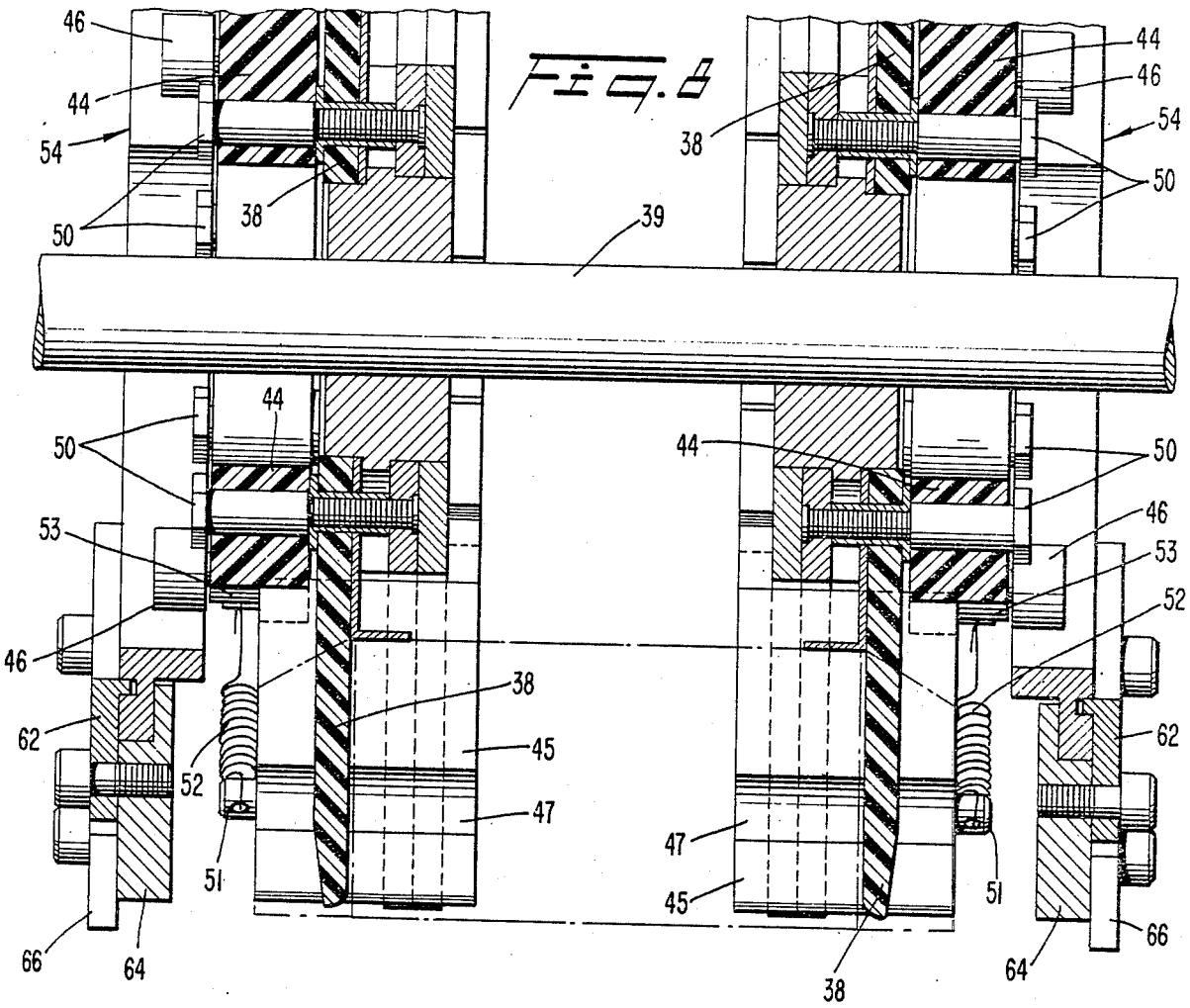
FIG. 8 is a sectional view along line VIII—VIII of FIG. 7.
Figure 9:
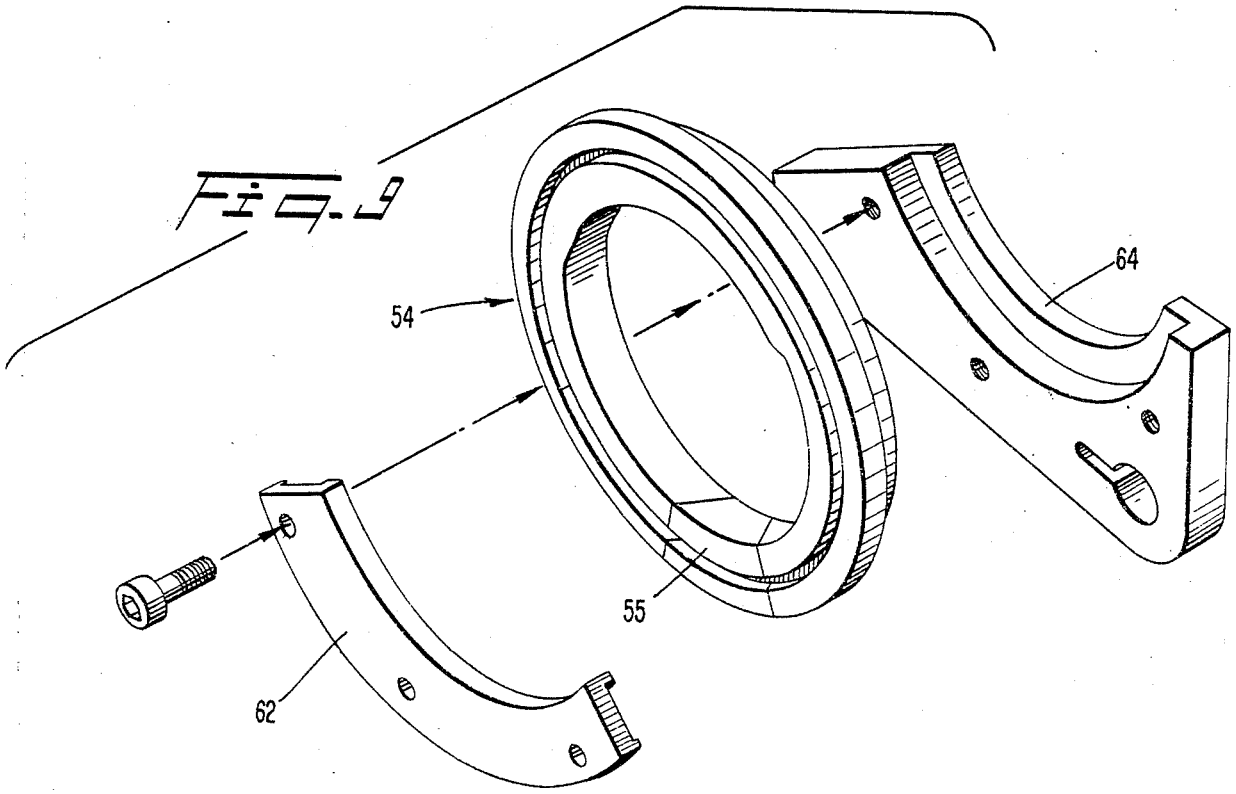
FIG. 9 is an exploded perspective view of cam means made in accordance with this invention.

A further embodiment of the present invention is shown in FIGS. 7 through 9. The assembly 40 includes a geneva wheel arrangement 42 which operates exactly the same as the geneva wheel assembly 15 of the earlier embodiment. The package 38 is draped with a sheet 35 of flexible material. At least one end portion of the sheet 35 includes a free edge 43 and projects outwardly from the package 38. The similar type of excess portion formed as a bubble across the entire width of the sheet 35 is formed in this particular embodiment. The lever member 44 pivots around the stud 50 while the cam follower 46 moves along a cam surface. The abutment surface 48 at the outer free end of lever member 44 is shaped to fit the backing support surface 47. The spring 52 fixed at one end by bolt 51 and on the other end by stud 53 on the lever 44 biases the member 44 to an open position.

The cam assembly 54 includes the cam surface which provides a positive displacement of the abutment face 48 into the shaped backing surface 47 formed in the backing member 45. This is disposed adjacent the pocket means of the geneva wheel assembly 42 as described earlier.

The cam assembly 54 is disposed and positioned accurately around the axis of shaft 39 using the bracket assembly 60. Bracket member 64 is fixed in position by use of the adjustable plate 66 onto the stationary frame of the wrapping machine adjacent the geneva assembly 42. The annular cam member of cam assembly 54 includes a removable section 55 which enables the cam member to be easily placed and positioned around the shaft 39. The removable section 55 has a wedge shaped cut so that the curved plate 62 need be only fixedly disposed against the outer surface of the annular ring to hold the removable section 55 in place to form a completed cam surface of the cam assembly 54. This is most clearly shown in FIG. 9.

The annular, split ring member 54 with its removable section 55 and shaped cam surface constitutes a significant improvement over the disc-type cam member 18 used in the earlier embodiment.

Each of the pockets of the assemblies 15 and 42 includes tucker blades 41 and package stop members 49. The tucker blades 41 effect the first or initial tuck that is established along one end and an edge of the package. Subsequent sides are then folded at other wrapping stations following the geneva assemblies 15 and 42.

While the Method and Apparatus for Wrapping an Article has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A method of wrapping an article, said method comprising the steps of:

(a) wrapping a sheet of thin, flexible wrapping material around said article to form at least one end portion including a free edge of the sheet and at least one side portion, said end and side portions projecting outwardly from said article, (b) providing a shaped backing means having a shaped supporting surface adjacent one surface of said projecting side portion and a pushing member adjacent the other surface of said projecting side portion, (c) pushing against said other surface with said pushing member to form a projecting, flexible excess portion in said projecting side portion against the shaped supporting surface while positioned around the article, and then (d) folding said end and side portions onto the article while maintaining the excess portion in the wrapping material thereby forming a loosely wrapped article.

2. A method as defined in claim 1 wherein the article has a rectangular cross-sectional shape and said excess portion being formed at a location laterally displaced from said free edge.

3. A method as defined in either the claims 1 or 2 wherein said flexible wrapping material consists of a heat sealable material.

4. The method as defined in either of claims 1 or 2 wherein said excess portion is formed as a bubble across the width of the sheet of material.

5. An assembly for wrapping an article, said assembly comprising:

(a) means for wrapping a sheet of thin, flexible wrapping material around said article to form at least one side portion of the sheet projecting outwardly from the article, (b) means for forming a projecting, flexible excess portion in said projecting side portion after the wrapping material has been wrapped around the article and (c) means for sealing the wrapping material around the article while maintaining the excess portion in the wrapping material thereby forming a loosely wrapped article, (d) said excess portion forming means includes shaped backing means having a shaped supporting surface adjacent one surface of said projecting side portion which supports and against which said excess portion is pressed, (e) said excess portion having a shape conforming to the shape of the supporting surface, (f) said excess portion forming means includes means for holding the thin, flexible material against the shaped supporting surface, (g) said material holding means includes a pushing member having an abutment face which pushes the thin, flexible material against the shaped supporting surface.

6. The assembly as defined in claim 5 wherein said positioning means includes means for draping the sheet of wrapping material around the article to form at least one end portion including a free edge of the sheet and projecting outwardly from the article.

7. The assembly as defined in claim 6 wherein said excess portion forming means is effective to form said excess portion at a location laterally displaced from said free edge.

8. The assembly as defined in claim 5 wherein said excess portion forming means is effective to form the excess portion as a bubble which projects outwardly from the article.

9. The apparatus as defined in claim 5 wherein the abutment face is shaped to conform to the shape of the shaped supporting surface.

10. The assembly as defined in claim 5 wherein said positioning means includes pocket means for holding the article having the thin, flexible material wrapped therearound and adjacent the material holding means.

11. The assembly as defined in claim 5 wherein said pushing member having a lever member pivotably mounted to move between an open position and a holding position, said lever member having a free end with an abutment face disposed to push the thin, flexible material against the shaped supporting surface when the lever member is in the holding position.

12. The apparatus as defined in claim 11 wherein said material holding means includes spring biasing means for urging the lever member to one of said open or holding positions and cam means for effecting positive displacement of the lever member to the other of said open or holding positions.

13. The assembly as defined in claim 12 wherein the lever member includes a cam follower which contacts said cam means and maintains the lever member in an open position, said spring biasing means urges the lever member to the holding position.

14. The assembly as defined in claim 12 wherein the lever member includes a cam follower which contacts said cam means and maintains the lever member in the holding position, said spring biasing means urges the lever member to an open position.

15. The assembly as defined in claim 14 wherein said cam means includes an annular, split ring member having a removable section and a shaped cam surface for contact with the cam follower, said material holding means includes bracket means for securing the removable section to maintain the split ring member as a unit placed to function with said cam follower.

16. In a wrapping machine, the combination comprising:

(a) means for draping a sheet of thin, flexible material around an article having a plurality of planar sides, (b) said draping means being effective to form at least one end portion including a free edge of the sheet and at least one side portion, said free edge and side portion projecting outwardly from the article, (c) pocket means for holding the article having the thin, flexible material wrapped therearound, (d) means for forming a flexible excess portion in said side portion projecting outwardly from a side of the article and extending along the wrapping material which is wrapped around the article disposed within said pocket means, (e) said pocket means including a side wall member having an indentation to receive said excess portion formed in the wrapping material, and (f) means for sealing the wrapping material around the article while maintaining the excess portion in the wrapping material thereby forming a loosely wrapped article;

(h) said excess portion forming means includes a backing member disposed adjacent said side wall member, a shaped supporting surface adjacent one surface of said projecting side portion against which the excess portion is conformed in shape and means for holding the thin, flexible material against the shaped supporting surface, (i) said material holding means includes a pushing member having an abutment face which pushes the thin, flexible material against the shaped supporting surface.

17. The combination as defined in claim 16 wherein the abutment face is shaped to conform to the shape of the shaped supporting surface.

18. The combination as defined in claim 16 wherein said pushing member having a lever member pivotally mounted to move between an open position and a holding position, said lever member having a free end with an abutment face disposed to push the thin, flexible material against the shaped supporting surface when the lever member is in the holding position.

19. The combination as defined in claim 18 wherein said material holding means includes spring biasing means for urging the lever member to one of said open or holding positions and cam means for effecting positive displacement of the lever member to the other of said open or holding positions.

20. The combination as defined in claim 19 wherein the lever member includes a cam follower which contacts said cam means and maintains the lever member in an open position, said spring biasing means urges the lever member to the holding position.

21. The combination as defined in claim 19 wherein the lever member includes a cam follower which contacts said cam means and maintains the lever member in the holding position, said spring biasing means urges the lever member to an open position.

22. The combination as defined in claim 21 wherein said cam means includes an annular, split ring member having a removable section and a shaped cam surface for contact with the cam follower, said material holding means includes bracket means for securing the removable section to maintain the split ring member as a unit placed to function with said cam follower.

* * * * *